US007344402B2

(12) United States Patent
Langgood et al.

(10) Patent No.: US 7,344,402 B2
(45) Date of Patent: Mar. 18, 2008

(54) APPARATUS AND METHOD FOR COMPONENT MODULE INSERTION AND REMOVAL PROTECTION

(75) Inventors: John K. Langgood, Cary, NC (US); Thomas Francis Lewis, Raleigh, NC (US); Kevin Michael Reinberg, Chapel Hill, NC (US); Kevin Shayne Dwayne Vernon, Durham, NC (US)

(73) Assignee: Lenovo Pte. Ltd., Singapore (SG)

( * ) Notice: Subject to any disclaimer, the term of this patent is extended or adjusted under 35 U.S.C. 154(b) by 0 days.

(21) Appl. No.: 11/377,002

(22) Filed: Mar. 16, 2006

(65) Prior Publication Data

US 2007/0218741 A1 Sep. 20, 2007

(51) Int. Cl.
*H01R 13/62* (2006.01)

(52) U.S. Cl. ..... 439/328; 439/157; 439/188; 439/911

(58) Field of Classification Search ..... 439/188, 439/325, 328, 157, 160, 911, 159
See application file for complete search history.

(56) References Cited

U.S. PATENT DOCUMENTS 4,119,818 A * 10/1978 Noschese ..... 200/50.21
4,418,971 A * 12/1983 Liss ..... 439/61
4,454,552 A 6/1984 Barnes et al.
4,798,923 A * 1/1989 Barwick et al. ..... 200/50.01
4,835,737 A * 5/1989 Herrig et al. ..... 710/302
4,887,188 A * 12/1989 Yoshida et al. ..... 361/684
5,275,573 A 1/1994 McCleerey
5,343,009 A * 8/1994 Araoka et al. ..... 200/322
5,636,347 A * 6/1997 Muchnick et al. ..... 710/302
5,822,196 A * 10/1998 Hastings et al. ..... 361/801
5,989,043 A * 11/1999 Han et al. ..... 439/157
6,215,686 B1 4/2001 Deneroff et al.
6,328,605 B1 12/2001 Walker et al.
6,401,157 B1 6/2002 Nguyen et al.
6,482,020 B1 11/2002 Yeh et al.

(Continued)

FOREIGN PATENT DOCUMENTS

JP 401166476 A 6/1989

(Continued)

OTHER PUBLICATIONS

Rich Hanson, "Adding RAM to Model 100" www.club100.org/library/ram100/index.html.

*Primary Examiner*—Truc T. Nguyen
*Assistant Examiner*—Xuong Chung-Trans
(74) *Attorney, Agent, or Firm*—Sawyer Law Group LLP

(57) ABSTRACT

Component module insertion and removal protection in computer systems. In one aspect, a connector assembly for a component module includes a connector that receives the component module and receives power from a power selection circuit, and a module attachment mechanism operative to secure the component module to the connector when a movable member is in an engaged position. In a disengaged position, the movable member allows the component module to be removed from the connector. When the movable member is moved from the engaged position, the state of a switch of the power selection circuit is changed, causing the power selection circuit to remove power from the connector and from at least a portion of a circuit board to which the connector is electrically coupled.

25 Claims, 3 Drawing Sheets

U.S. PATENT DOCUMENTS

| | | | |
|---|---|---|---|
| 6,585,542 | B2 | 7/2003 | Nishio et al. |
| 6,619,991 | B2 | 9/2003 | Nishio et al. |
| 6,808,424 | B2 | 10/2004 | Kaneshiro et al. |
| 2004/0193777 | A1 | 9/2004 | LaBerge |

FOREIGN PATENT DOCUMENTS

| | | | |
|---|---|---|---|
| JP | 406214893 | A | 8/1994 |
| JP | 2002042060 | A | 2/2002 |

* cited by examiner

APPARATUS AND METHOD FOR COMPONENT MODULE INSERTION AND REMOVAL PROTECTION

FIELD OF THE INVENTION

The present invention relates to computer systems, and more particularly to component modules and module connectors in computer systems.

BACKGROUND OF THE INVENTION

Many computer systems include connection mechanisms that allow components of the systems to be removed and replaced with other compatible components. For example, functions such as video output, sound output, and data storage (hard disks, CD-ROM, etc.) are provided as removable components that are connected to the computer system via interface connectors. Some components are in the form of modules, circuit boards, or cards which are plugged into connectors, slots, or sockets on a circuit board of the computer system, such as a main board or motherboard.

For example, computer memory, such as Random Access Memory (RAM), often comes in the form of a removable module of a computer system, so that it can be upgraded or replaced with other memory. For many current personal computer systems, RAM typically comes in the form of Dual In-line Memory Modules (DIMMs), which include a number of semiconductor memory chips connected to a small circuit board. A DIMM is inserted into a DIMM connector of a motherboard or other circuit board to connect the DIMM to the computer system and allow a microprocessor to access the memory of the DIMM. RAM can alternatively be provided in the form of other types of memory modules or components.

A potential problem with the current DIMM devices occurs during insertion or removal of a DIMM (or similar memory module). In some system architectures, there is a need to provide power to the DIMMs at all times to preserve context, e.g., preserve the state of memory. This can lead to a servicer or operator to remove a DIMM without knowing that it is being powered by the system. If the DIMM is powered, its removal can result in damage to the DIMM or main board components via a short circuit between the power and a ground pin, or between power and a data pin on the DIMM. This can occur, for example, if the operator does not pull the DIMM out uniformly or evenly from the connector. In other cases, power might be currently provided to a DIMM connector when a DIMM is being inserted therein, possibly resulting in a similar short circuit.

One existing solution for reducing this possibility of damage to DIMM or main board is to provide recessed power and ground pins on the DIMM connector. The recessed pins are reduced in length compared to the other pins so that when the DIMM is removed, for example, the power and ground connections between DIMM and connector are removed first as the DIMM is pulled away, thus removing the power from the DIMM before the remainder of the pins have their connection to the main board removed. However, the possibility of damage to DIMM or main board components is still present, if, for example, the operator removes the DIMM unevenly or in some other way that causes a short.

Other component modules, like peripheral cards or interface cards, can similarly be plugged into interface connectors on motherboards or other boards of a computer system to provide or enhance peripheral capability of the system.

Such interface cards can include peripheral functions such as network interface, wireless interface, or other communications capability, graphics video output, sound output, other I/O capability, etc. Some of these component modules also may have power shorting issues when the module is inserted or removed.

Accordingly, what is needed is the ability to insert and remove a memory module or other type of module from a connector without the possibility of a damaging short between power and other pins of the module or connector. The present invention addresses such a need.

SUMMARY OF THE INVENTION

The invention of the present application relates to protection of component modules and other system components during insertion and removal of the component modules from module connectors in computer systems. In one aspect of the invention, a connector assembly for providing power protection for inserting and removing a component module in a computer system, includes a connector that receives the component module and receives power from a power selection circuit, and a module attachment mechanism coupled to the connector and operative to secure the component module to the connector when a movable member is in an engaged position. When in a disengaged position, the movable member allows the component module to be removed from the connector. When the movable member is moved from the engaged position, the state of a switch of the power selection circuit is changed, causing the power selection circuit to remove power from the connector and from at least a portion of a circuit board to which the connector is electrically coupled.

In another aspect of the invention, an apparatus for providing power protection during insertion and removal of a component module in a computer system includes a connector coupled to a circuit board, the connector operative to receive the component module and including a module attachment mechanism, where the module attachment mechanism includes a movable member that secures the component module in the connector when in an engaged position and allows the component module to be removed from the connector when in a disengaged position. A power selection circuit is coupled to the circuit board and operative to provide power to the connector and to the component module received by the connector, the power selection circuit including a switch having a state changed by the movable member when the movable member is moved out of the engaged position. The switch's change in state causes power to be removed from the connector and from at least a portion of the circuit board by the power selection circuit.

In another aspect of the invention, a method for providing power protection for insertion and removal of a component module in a computer system includes providing a connector coupled to a circuit board, the connector operative to receive the component module and including a module attachment mechanism, where the module attachment mechanism includes a movable member that secures the component module in the connector when in an engaged position and allows the component module to be disconnected from the connector when in a disengaged position. Power is removed from the connector and from at least a portion of the circuit board when the state of a switch is changed by the movable member when the movable member is moved out of the engaged position toward the disengaged position.

The present invention provides a component module connector that has power automatically removed when a component module is able to be inserted into or removed from a connector. Power is also removed from related components on the circuit board connected to the connector. This prevents damage to components and connector from possible short circuits caused by the application of power during insertion or removal.

DETAILED DESCRIPTION

The present invention relates to computer systems, and more particularly to component modules and module connectors in computer systems. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

The present invention is mainly described in terms of particular systems provided in particular implementations. However, one of ordinary skill in the art will readily recognize that this method and system will operate effectively in other implementations. For example, the computer system implementations usable with the present invention can take a number of different forms.

To more particularly describe the features of the present invention, please refer to FIGS. 1-3 in conjunction with the discussion below.

Figure 1:
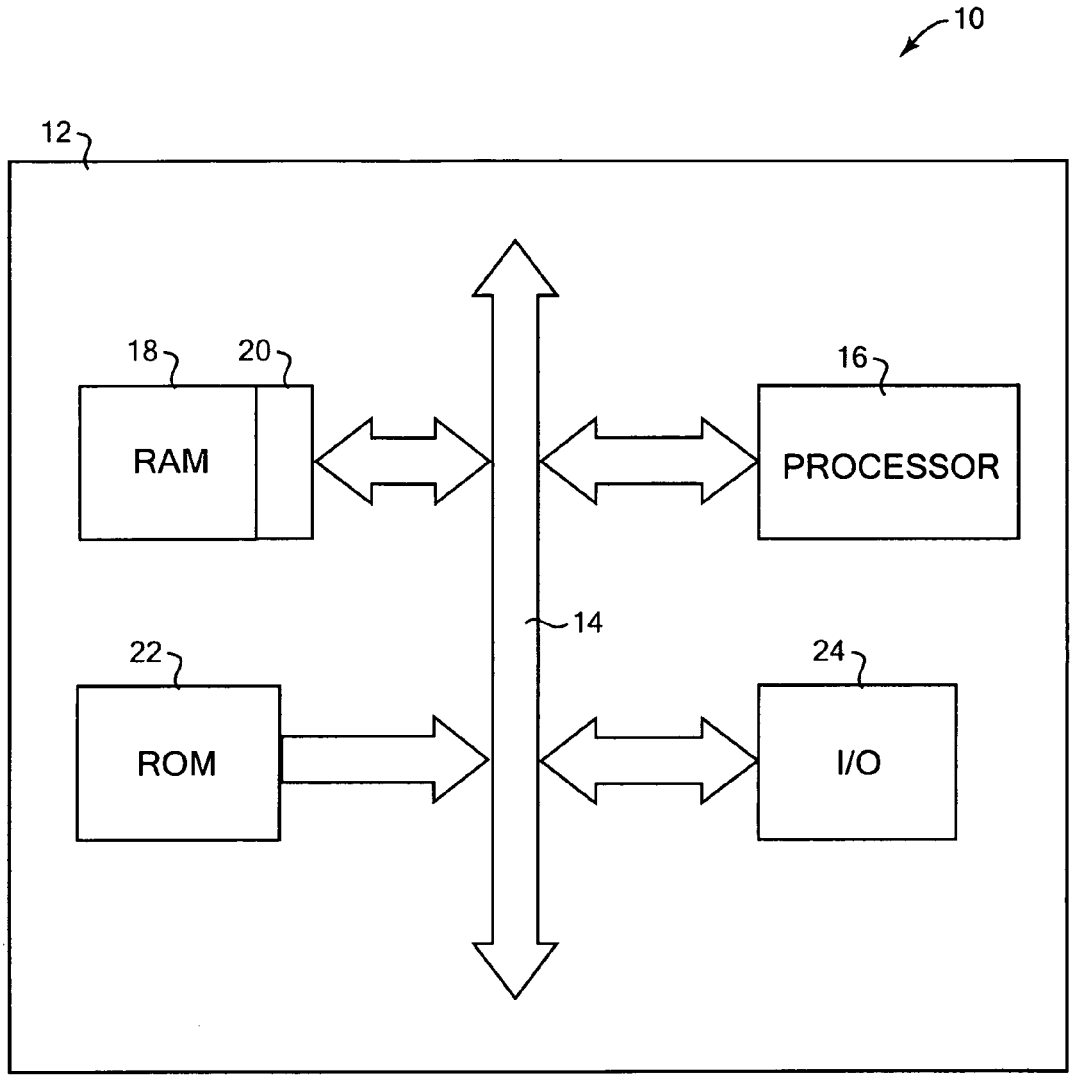
FIG. 1 is a block diagram illustrating a computer system suitable for use with the present invention.

FIG. 1 is a block diagram illustrating a general computer system 10 suitable for use with the present invention. Computer system 10 can be, for example, a mainframe computer, desktop computer, workstation, portable computer, or electronic device. Computer system 10 includes exemplary components which can be provided on a main board 12 and coupled to a system bus 14 of the main board. Processor 16 is one such component, and can include one or more microprocessors which control functions of the computer system 10. For example, the microprocessor can be any available microprocessor from IBM Corporation, Intel Corporation, Advanced Micro Devices, Inc., etc.

RAM 18 is volatile memory connected to the main board of the computer system to store data for use in the operation of the system. Processor 16, for example, can access RAM 18 via the system bus 14. In the described embodiment, RAM 18 is provided as one or more component modules, i.e., memory modules (or "cards"). For example, one or more Dual In-line Memory Modules (DIMMs) are commonly used, which include semiconductor memory chips connected to a small circuit board. The small circuit board is plugged into main board 12 in the computer system 10 via a DIMM connector 20 that is connected to the main board, thus connecting the DIMM to the system bus 14. A DIMM can be removed from or replaced in the connector 20 as desired, e.g., to provide different amounts of RAM to the computer system 10. Connector 20 can include one or multiple slots, each slot receiving a DIMM. Other types of memory modules and connectors can be used in other embodiments. One embodiment of a memory module connector 20 of the present invention is described in greater detail below with respect to FIGS. 2A and 2B.

Read-only memory (ROM) 22 can be provided as non-volatile memory for the computer system 10, and is connected to the system bus 14. ROM 22 can be any suitable type of non-volatile memory, e.g., erasable programmable read only memory (EPROM), flash memory, etc.

I/O controllers and circuitry 24 can also be connected to the main board 12 and to the system bus 14, and can connect the system 10 to components and peripherals, such as data storage devices (hard disk, CD-ROM, etc.), output devices (display, printer, etc.), input devices, other computer devices over a network, etc. In some embodiments, one or more of the I/O controllers 24 can be in the form of component modules, i.e., peripheral or interface cards, which plug into a compatible connector on the main board 12 similarly to a memory module. The connector for these interface cards (or other types of component modules for system 10) can be implemented according to the present invention similarly to the memory module connector 20.

It should be noted that the system 10 shown in FIG. 1 is generalized. Particular architectures may have specific configurations different from that shown in FIG. 1. For example, instead of RAM, ROM, and I/O communicating over a system bus 14, there can be a chipset that includes memory, I/O, and other controllers. In some architectures, the chipset can include a memory controller that connects directly to the processor and memory, and an I/O controller that connects I/O and ROM to the processor through the memory controller. In other embodiments, the memory controller can be built into the processor and a separate I/O controller can connect to the I/O interface of the processor.

Figure 2A:
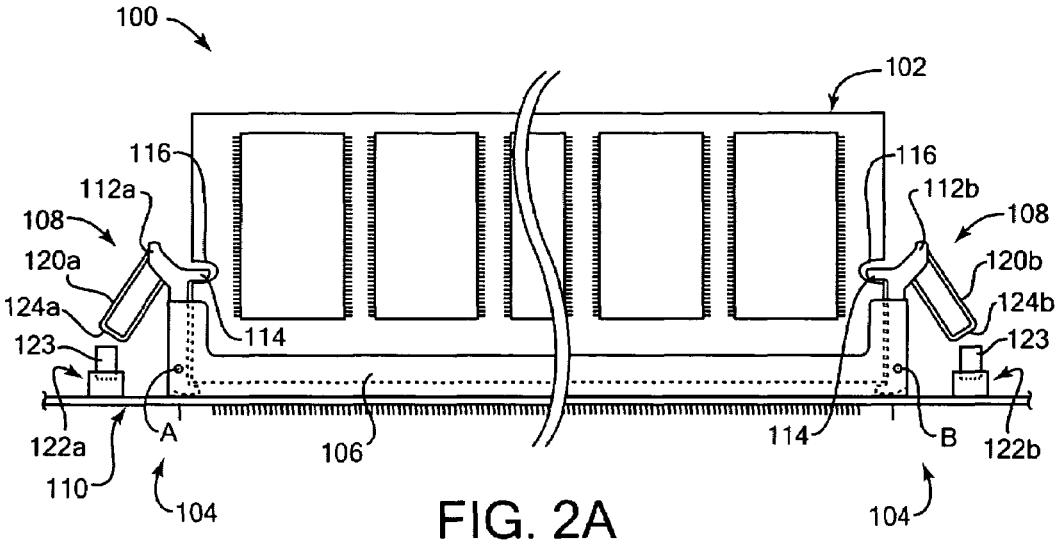
FIG. 2A is a side elevational view of one embodiment of a memory module and module connector of the present invention.

FIG. 2A is a side elevation view of one embodiment of a memory module assembly 100 of the present invention for use in a computer system such as system 10 and which allows insertion or removal of a memory module without power being supplied to the memory module or memory components. Memory module assembly 100 includes a memory module 102 and a memory module connector 104.

Memory module 102 provides RAM 18 to the system 10 and can be any suitable memory module that can be connected to or disconnected from a main board in a computer system to add or remove memory. For example, one common type of memory module is a DIMM used for RAM 18 of computer system 10, in which one or more memory semiconductor chips is connected to a small circuit board having edge connector contacts. In other embodiments, other types of memory modules can be used in the present invention. In some embodiments, the memory module 100 can include additional circuitry for other functions.

The memory module 102 is shown inserted in memory module connector 104 of the present invention. Connector 104 includes a base portion 106 and a module attachment mechanism 108.

Base portion 106 is mounted on and attached to a main circuit board 110, which can be the motherboard in a personal computer, a smaller circuit board that is plugged into a main board, or any other suitable board or support of a computer system. The connector base portion 106 includes several conductive contacts which are electrically connected to circuits of the circuit board 110 and which connect with associated contacts on the memory module 102 when the memory module is inserted into the connector 104.

Figure 2B:
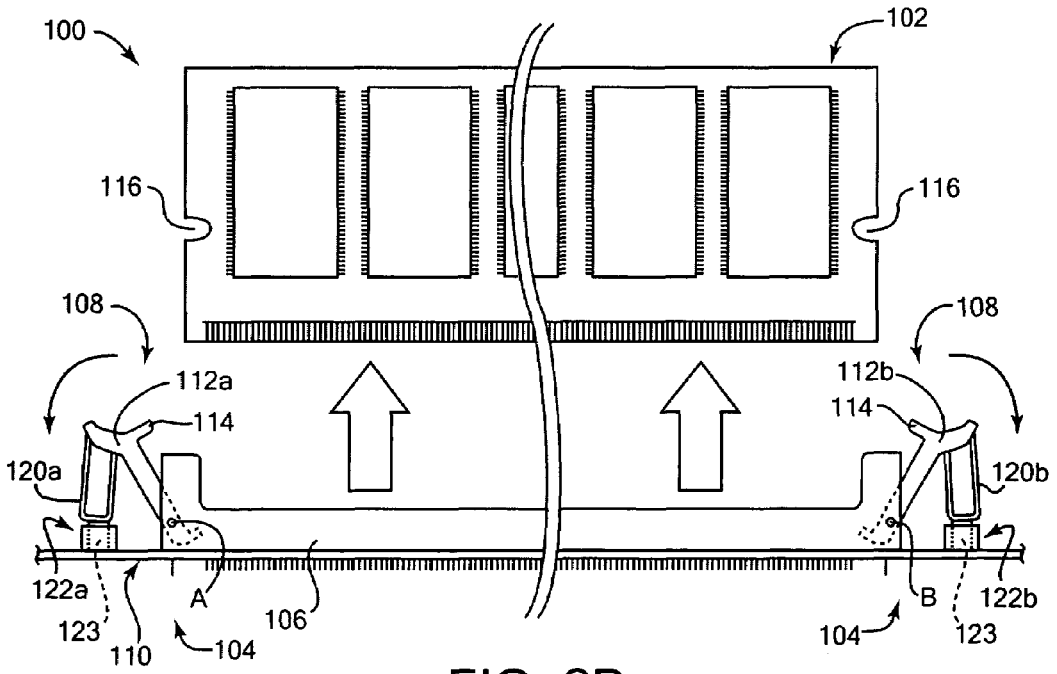
FIG. 2B is a side elevational view of the memory module and module connector of FIG. 2A in which the memory module has been removed.

The module attachment mechanism 108 is used to secure the memory module 102 within the memory module connector 104, and can be in an engaged position (shown in FIG. 2A) and a disengaged position (see FIG. 2B). In the described embodiment, attachment mechanism 108 includes two pivoting arms 112*a* and 112*b*, each of which secures the module 102 when in the engaged position as shown. The pivoting arms each can rotate a particular amount about an axis A or B, away from the connector 106 and memory module 102. In the engaged position, a tab 114 on each pivoting arm is positioned to fit within a slot 116 on the memory module so that the memory module cannot be removed without first rotating each pivoting arm 112*a* and 112*b* away from the memory module. Other mechanisms can also be used which similarly secure the memory module 102 in place when the pivoting arms 112*a* and 112*b* are in the engaged position.

The connector 104 of the present invention also includes a removal power protection feature. In the described embodiment, this protection feature includes a selection member 120*a* and a selection member 120*b*, each of which is rigidly coupled to the associated pivoting arm 112*a* and 112*b*, respectively. The selection members 120*a* and 120*b* can be provided as any rigid member, made of a suitable material such as plastic. The selection members 120*a* and 120*b* can be made separately and then attached to the pivoting arms 112*a* and 112*b*, or the selection members can be made as part of, and unitary with, the pivoting members 112*a* and 112*b*.

Beneath each selection member 120*a* and 120*b* is provided an associated contact switch 122*a* and 122*b*, respectively. Each contact switch 122*a* and 122*b* is coupled to the circuit board 110 to which the base portion 106 of connector 104 is connected. The switches can be any suitable type; e.g., a switch that includes a moving part that closes or opens the switch, a switch that senses when a conductive material, magnetic material, or other specific material contacts it, an optical switch, or other type of switch or sensor. The switches 122*a* and 122*b* are both connected to (and can be considered part of) a power selection circuit that is provided on the circuit board 110. The power selection circuit is described in greater detail below with respect to FIG. 3.

The selection member 120*a* is positioned such that when the pivoting arm 112*a* is moved to a disengaged position or is otherwise positioned away from the fully engaged position, the end 124*a* of the member 120*a* will move downward to contact the contact switch 122*a*, which changes the state of that switch and has the effect of causing a different switch signal to be sent to the power selection circuit than in the engaged position, and may assist in causing the disconnecting of power to the connector 104 as described below. Similarly, the selection member 120*b* is positioned such that the end 124*b* moves to contact switch 122*b* when the arm 112*b* is not in the fully engaged position to similarly change the state of that switch and send a different switch signal to the power selection circuit. In the example embodiment shown, each switch 122*a* and 122*b* has a moving element 123 which changes the state of the switch as soon as a selection member 120*a* or 12*b* contacts it and moves it toward the circuit board 110, as described below.

FIG. 2B is a side elevational view of the memory module assembly 100 of FIG. 2A in which the pivoting arms 112*a* and 112*b* have been moved to disengaged positions, which allows the memory module 102 to be removed from the connector 104, e.g., by an operator pulling the module 102 from the base portion 106.

Before removing the memory module 102, the operator must move the pivoting arms 112*a* and 112*b* to the disengaged positions.

When the operator moves both of the pivoting arms 112*a* and 112*b*, the end 124*a* and 124*b* of each of the selection members 120*a* and 120*b* moves with the pivoting arm and contacts the associated contact switch 122*a* or 122*b*. When either switch, or both switches, are so contacted, the state of the switch(es) is changed and the power is removed to the connector 104.

The removal of power allows the memory module 102 to be removed safely, with no possibility of a short circuit between power and other pins. In the described embodiment, either end of the memory module 102 cannot be removed until the associated pivoting arm is fully disengaged and the associated switch contacted. Note that in the described embodiment, if either one of the pivoting arms is moved (disengaged) and associated switch is contacted, the power is removed, thus preventing the possibility that only one end of the memory module is pulled out of the connector while power is being provided. The power removal operation is described in greater detail below with respect to FIG. 3.

It should be noted that the switches 112*a* and 112*b* are preferably positioned so that they will be contacted (or otherwise caused to change state) even when the associated pivoting arm 112*a* or 112*b* is only slightly away from its engaged position. This allows the mechanism to disconnect power to the connector 104 (and other components) in cases where the memory module 102 is not fully seated in the connector or is otherwise incorrectly seated, since in such a case one or both pivoting arms 112*a* and 112*b* will typically not be able to fully move into the associated slot 116 of the memory module, and thus the associated switch 112*a* or 112*b* is still contacted or activated.

In the described embodiment, to accommodate the full motion of the pivoting arm, the moving element 123 of a switch 122*a* or 122*b* is contacted and then moved toward the circuit board with the end 124*a* or 124*b* of the contacting pivoting arm over the range of pivoting arm motion, to the disengaged position. Preferably, as explained above, the state of the switch is changed at or soon after contact. In other embodiments, the switch can be an optical switch or otherwise have a sensing field that can sense the pivoting arm from a position just out of the fully engaged position, up to the full disengaged position.

In an alternate embodiment, a different attachment mechanism can be used. For example, instead of pivoting members 112*a* and 112*b*, sliding or translating members can be used, where the sliding members change the state of the switches 122*a* and 122*b* when both moved away from the engaged position that secures the memory module in the connector 106.

In another embodiment, switches 122*a* and 122*b* can be provided in the base portion 106 of the memory connector under the pivoting arms 112*a* and 112*b*, or on the pivoting arms. For example, a switch having a moving element 123, similar to those in the embodiment described above, can be positioned in the connector 106 under or near each pivoting arm. The element 123 can be contacting and connecting two pins of the base 106 of the connector when the associated arm 112*a* or 112*b* is in the engaged position, which allows power to be received by the connector 104. The element 123 can be allowed to move away from the circuit board 110 and disconnect the pins to change the state of the switch when the end of the pivoting arm moves away as a user starts moving the pivoting arm to the disengaged position, thus disconnecting power. For example, one pin can be connected to a voltage source and the other pin connected to one terminal of an AND gate in a power selection circuit, as described below for FIG. 3. For example, a DIMM connector typically has 2 rows of pins, and there can be dedicated pins at each end of the connector for this purpose. Or, the pivoting arms can each include a conductive end near the axis of rotation A or B, which could contact or disconnect similar pins in the base portion 106 of the connector to change the state of an associated switch.

Figure 3:
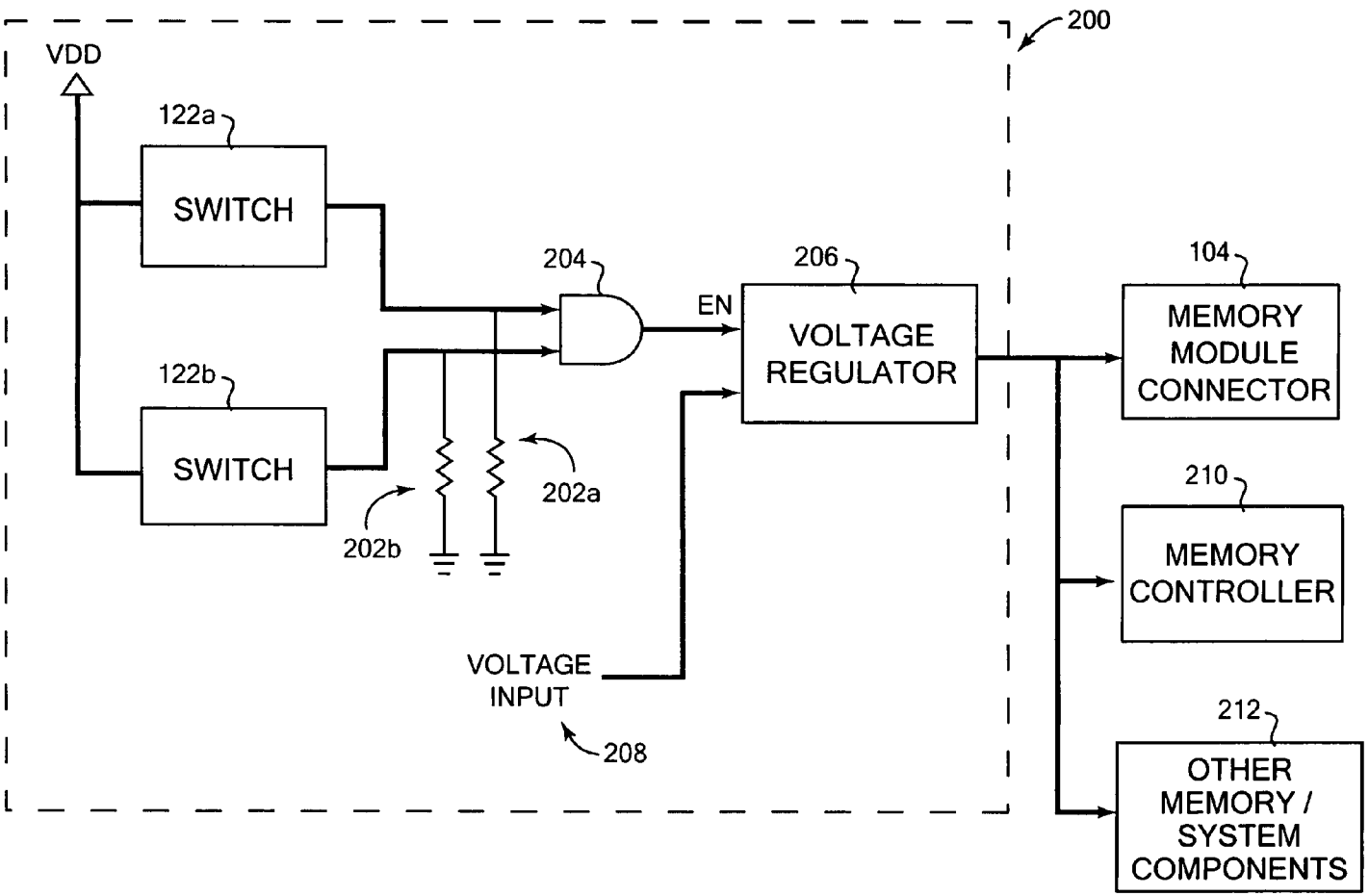
FIG. 3 is a block diagram illustrating one embodiment of a power selection circuit of the present invention for use with the memory module connector of the present invention.

FIG. 3 is a block diagram of an example of a power selection circuit 200 of the present invention, which can be connected to the selection switches 122*a* and 122*b* shown in FIGS. 2A and 2B. This circuit can be provided on the circuit board 110 which supports and is electrically coupled to the memory module connector 104, e.g., board 110 can be a main board in a computer system, or a different circuit board or support. Alternatively, some parts of circuit 200 can be provided at a different location and connected to the switches 122*a* and 122*b* via electrical connections.

Selection switches 122*a* and 122*b* are provided in circuit 200, and each switch is, in the described embodiment, closed when the associated pivoting arm of the module attachment mechanism 108 is in the fully engaged position, and open when the associated arm contacts it when moved away from the engaged position toward the disengaged position. A voltage VDD can be connected to one terminal of the switches, and the VDD signal is allowed to pass through the switches when they are closed.

The other terminals of the switches 122*a* and 122*b* are connected as inputs to an AND gate 204. In addition, the inputs of the AND gate 204 are connected to ground via resistors 202*a* and 202*b*, each resistor connected between the associated input and ground. The output of the AND gate is coupled to an enable input of a voltage regulator 206. The voltage regulator 206 receives a voltage input 208 from a different power source in the computer system.

The output of the voltage regulator 206 is coupled to the memory module connector 104 and provides the power to the connector which is provided in turn to the memory module plugged into the connector 104. The voltage output of regulator 206 is also be provided to other components in the memory system of the computer, such as a memory controller 210 which interfaces control signals between the processor 16 and the memory (RAM 18 and ROM 20), and other memory or system components 212. The components 212 can be related to memory functionality, and/or other functionality in the computer system (I/O, processor functions, etc.) which may be desired to be powered down upon memory module insertion or removal. Any required components in power selection circuit 200 needed to drop the voltage to a required level for a particular memory or system component can also be provided. The memory controller 210 and other system components 212 are provided on a portion of the circuit board 110 that gets power from the voltage regulator 206. For example, some or all of these memory and system components 210 and 212 can be provided on the circuit board 110 in close proximity to the switches 122*a* and 122*b*.

The power selection circuit embodiment shown in FIG. 3 operates as follows. When switches 122*a* and 122*b* are in a closed state, as when the pivoting arms 112*a* and 112*b* are both in the engaged position, then the VDD source voltage is provided to the AND gate 204, which provides a high output from the AND gate as the enable signal to the voltage regulator 206. This enables the voltage input 208 to be provided from the output of the voltage regulator 206 to the module connector, memory controller, and other memory components on the circuit board 110 to which the connector 104 is electrically coupled.

When one of the selection members 120*a* and 120*b* contacts (or otherwise changes the state of) its associated switch 122*a* or 122*b*, the switch changes to an open state. This causes a low signal to be provided to the corresponding input of the AND gate 104 from ground, and causes the output of the AND gate to go low. This disables the voltage regulator and prevents the voltage input 208 from being output from the voltage regular to the part of the circuit board 110 holding the related components, which in this case are the memory module connector, memory controller, and other memory components on the main board. Similarly, when both the selection members 120*a* and 120*b* contact (or otherwise change the state of) switches 122*a* and 122*b*, two low signals are provided to AND gate 104 and the resulting low signal disables the regulator and prevents voltage signal 208 from powering the portion of the circuit board having the memory connector and memory components.

It should be noted that other circuit implementations can be used in other embodiments which provide equivalent or similar functionality. For example, the switches can be open in the engaged position, and closed by the pivoting arms; and a NOR gate can be used to provide the enable signal to the voltage regulator, or an active low enable signal can be used for the regulator. In alternate embodiments, switches provided in other locations, such as in the base 106 of the connector, can be open in one arm position and closed in the other position, as appropriate for the particular power selection circuit 200 used.

In other embodiments in which a peripheral or interface card is provided as the component module, then a circuit for driving and/or controlling that peripheral card is also disconnected from power, that circuit located in the motherboard or main board which supports the connector. This is similar to removing the power from the memory components on the circuit board 110 in the memory module implementation described above.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A connector assembly for providing power protection for inserting and removing a memory module in a computer system, the apparatus comprising:

a connector electrically coupled to a circuit board, the connector receiving the memory module and receiving power via a power selection circuit; and a module attachment mechanism coupled to the connector and operative to secure the memory module to the connector when a movable member is in an engaged position, and when in a disengaged position, the movable member allows the memory module to be removed from the connector, wherein when the movable member is moved from the engaged position, the state of a switch of the power selection circuit is changed, causing the power selection circuit to remove power from the connector and to remove power from one or more circuit components of the circuit board, the one or more circuit components being connected to the power selection circuit and being different than the connector, the module attachment mechanism, and the power selection circuit, wherein the movable member contacts the switch when out of the engaged portion.

2. The connector assembly of claim 1 wherein the switch is provided on the circuit board.

3. The connector assembly of claim 2 wherein the one or more circuit components includes at least one memory component provided on the circuit board.

4. The connector assembly of claim 3 wherein the at least one memory component includes a memory controller.

5. The connector assembly of claim 3 wherein the power selection circuit includes a voltage regulator that is enabled to provide power to the connector by the switch.

6. The connector assembly of claim 1 wherein the movable member is a first movable member, and further comprising a second movable member, wherein each movable member changes the state of a different associated switch, and wherein the power is removed from the connector when either of the movable members changes the state of its associated switch.

7. The connector assembly of claim 6 wherein the power selection circuit includes an AND gate receiving the outputs from the first and second switches, wherein the AND gate provides an output to an enable input of a voltage regulator providing the power to the connector and to the one or more circuit component.

8. The connector assembly of claim 6 wherein the power selection circuit includes a selection component receiving the outputs from the first and second switches, wherein the component causes a signal to be sent to an enable input of a voltage regulator providing the power to the connector and to the one or more circuit components of the circuit board.

9. The connector assembly of claim 8 wherein the component includes a logic gate.

10. The connector assembly of claim 1 wherein the movable member is a pivotable member that is rotatable about an axis.

11. The connector assembly of claim 1 wherein the one or more circuit components include a controller that interfaces control signals between the component module and other parts of the circuit board.

12. An apparatus for providing power protection during insertion and removal of a memory module in a computer system, the apparatus comprising:

a connector coupled to a circuit board, the connector operative to receive the module and including a module attachment mechanism, wherein the module attachment mechanism includes a movable member that secures the memory module in the connector when in an engaged position and allows the memory module to be removed from the connector when in a disengaged position; and a power selection circuit coupled to the circuit board and operative to provide power to the connector and to the memory module received by the connector, the power selection circuit including a switch having a state changed by the movable member when the movable member is moved out of the engaged position, wherein the change in state of the switch causes power to be removed by the power selection circuit from the connector and from one or more circuit components of the circuit board, the circuit components being connected to the power selection circuit and being different than the connector, the module attachment mechanism, and the power selection circuit, wherein the movable member contacts the switch when out of the engaged portion.

13. The apparatus of claim 12 wherein the switch is provided on the circuit board.

14. The apparatus of claim 13 wherein the at least a portion of the circuit board includes at least one memory component provided on the circuit board, from which power is removed by the power selection circuit.

15. The apparatus of claim 14 wherein the at least one memory component includes a memory controller.

16. The apparatus of claim 12 wherein the power selection circuit includes a voltage regulator that is enabled to provide power to the connector by the switch.

17. The apparatus of claim 12 wherein the movable member is a first movable member, and further comprising a second movable member, wherein each movable member changes the state of a different associated switch, and wherein the power is removed from the connector when either of the movable members changes the state of its associated switch.

18. The apparatus of claim 17 wherein the power selection circuit includes a logic gate receiving the outputs from the associated switches, wherein the logic gate causes a signal to be sent to an enable input of a voltage regulator providing the power to the connector and to the one or more circuit components of the circuit board.

19. The apparatus of claim 12 wherein the one or more circuit components include a controller that interfaces control signals between the component module and other parts of the circuit board.

20. A method for providing power protection for insertion and removal of a memory module in a computer system, the method comprising:

providing a connector coupled to a circuit board, the connector operative to receive the memory module and including a module attachment mechanism, wherein the module attachment mechanism includes a movable member that secures the memory module in the connector when in an engaged position and allows the memory module to be disconnected from the connector when in a disengaged position; and removing power from the connector and from at least one circuit component of the circuit board when the state of a switch is changed by the movable member when the movable member is moved out of the engaged position toward the disengaged position, the at least one circuit component being different than the connector, the module attachment mechanism, and the power selection circuit, wherein the movable member contacts the switch when out of the engaged portion.

21. The method of claim 20 wherein the switch is provided on the circuit board and wherein the removing of power is performed by a power selection circuit coupled to the circuit board which provides power to the connector, to the memory module connected to the connector, and to the at least one circuit component of the circuit board, and wherein the power selection circuit includes the switch.

22. The method of claim 21 wherein the movable member is a first movable member, and further comprising a second movable member, wherein each movable member changes the state of a different associated switch, and wherein the power is removed from the connector and from the at least one circuit component when either of the movable members changes the state of its associated switch.

23. The method of claim 22 wherein the power selection circuit includes a logic gate receiving the outputs from the associated switches, wherein the logic gate causes a signal to be sent to an enable input of a voltage regulator providing the power to the connector and to the at least one circuit components of the circuit board.

24. The method of claim 20 wherein the state of the switch is changed when contacted by the movable member, and wherein the at least one circuit component includes at least one memory component provided on the circuit board, from which power is removed when the switch is contacted.

25. A connector assembly for providing power protection for inserting and removing a component module in a computer system, the apparatus comprising:

a connector that receives the component module and receives power via a power selection circuit; and a module attachment mechanism coupled to the connector and including a first movable member and a second movable member, the module attachment mechanism operative to secure the component module to the connector when the movable members are in an engaged position, and when in a disengaged position, the movable members allow the component module to be removed from the connector, wherein when either of the movable members are moved from the engaged position, the state of an associated switch of the power selection circuit is changed, causing the power selection circuit to remove power from the connector and from at least one circuit component provided on a circuit board to which the connector is electrically coupled, the at least one circuit component being different than the connector, the module attachment mechanism, and the power selection circuit, wherein each movable member changes the state of a different associated switch, and the power is removed from the connector and the at least one circuit component when either of the movable members changes the state of its associated switch, and wherein the power selection circuit includes a gate receiving the outputs from the first and second switches, wherein the gate causes a signal to be sent to an enable input of a voltage regulator providing the power to the connector and to the at least one circuit component, the gate causing the signal based on the received outputs of the first and second switches wherein the movable member contacts the switch when out of the engaged portion.

* * * * *